United States Patent [19]

Raulins

[11] 4,072,190

[45] Feb. 7, 1978

[54] MOTION COMPENSATOR

[75] Inventor: George M. Raulins, Dallas, Tex.

[73] Assignee: Otis Engineering Corporation, Dallas, Tex.

[21] Appl. No.: 709,959

[22] Filed: July 30, 1976

[51] Int. Cl.[2] ..... E21B 7/12

[52] U.S. Cl. ..... 166/.5; 175/321

[58] Field of Search ..... 175/321, 293; 285/302; 166/.5

[56] References Cited

U.S. PATENT DOCUMENTS

| | | | |
|---|---|---|---|
| 3,311,180 | 3/1967 | Gilreath et al. | 175/293 |
| 3,329,221 | 7/1967 | Walker | 175/296 |
| 3,599,735 | 8/1971 | Slator | 175/293 |
| 3,764,168 | 10/1973 | Kisling et al. | 285/302 |

*Primary Examiner*—James A. Leppink
*Attorney, Agent, or Firm*—Vinson & Elkins

[57] ABSTRACT

Disclosed is a motion compensator to permit relative movement between an underwater well installation and a vessel on the water surface. The motion compensator includes telescoping elements, seals between the telescoping elements and ports to permit lubrication of the seals. A method of using the motion compensator is also disclosed. This abstract is neither intended to define the invention of the application which, of course, is measured by the claims, nor is it intended to be limiting as to the scope of the invention in any way.

27 Claims, 5 Drawing Figures

26
28
34
P
32
36
86
30
84
88
90
22
24
82
80
10
20
18
W
F
12
14
16

MOTION COMPENSATOR

BACKGROUND OF THE INVENTION

1. Field of the Invention

This invention relates to a motion compensator to be placed in a well pipe to permit relative movement between an underwater well installation and a floating vessel on the water surface. The motion compensator is particularly useable while conducting a production test of an underwater well. Additionally, the invention relates to a method for using the motion compensator 2. The Prior Art Motion compensators to permit relative movement between an underwater well installation and a floating vessel are well known.

Motion compensators may take the form of an inner-sleeve telescopable within an outer barrel with seal means disposed between the sleeve and barrel as illustrated in U.S. Pat. Nos. to McNeill 2,606,003; Kofahl 3,179,179; Lacy 3,211,224; and Walker 3,329,221.

Motion compensators may be utilized in a well drill string as illustrated by U.S. Pat. Nos. to Ware 3,194,330; Slator et al 3,599,735; and Kisling III et al 3,764,168 or in a well test string as illustrated by U.S. Pat. Nos: to Hyde 3,354,950; Young et al 3,741,305; Manes et al 3,646,995; Kisling III 3,643,505; and Nutter 3,823,773.

A pressure balanced motion compensator, wherein the forces due to well fluid pressure tending to expand the compensator are balanced by the forces due to well fluid pressure tending to contract the compensator, is disclosed in U.S. Pat. No. 3,354,950 to Hyde.

One persistent problem with motion compensators has been seal failure. As the floating vessel oscillates due to wave action, telescoping elements of the motion compensator move relative to each other to accommodate the oscillation. During the telescoping action, the seal surfaces are exposed to well fluids. The fluids contain abrasive particles. The particles tear up the seals and contribute to seal failure.

Various attempts have been made to prolong seal life and thereby provide a motion compensator that can be used longer. U.S. patent to Hanes et al U.S. Pat. No. 3,647,245 discloses a telescoping pipe joint wherein the seal assembly is impregnated with a lubricant before the joint is positioned within the well pipe. The aforementioned patent to Slater et al U.S. Pat. No. 3,599,735 discloses a telescoping pipe joint wherein, before the joint is positioned within the well pipe, an annular cavity between two seal assemblies is filled with lubricant. The aforementioned patent to Kisling III et al, U.S. Pat. No. 3,764,168 includes a seal tube to isolate the seal wear surface on the telescoping element from well fluids.

However, present motion compensators do not have a sufficient life span for some operations presently being contemplated for offshore wells. Present well tests from floating vessels generally last for 4 hours, however, contemplated production tests are expected to last from 12 to 36 hours. The telescoping elements of a motion compensator utilized during such a production test would undergo much more relative movement than is undergone by the elements of present motion compensators. With more relative movement the likelihood of seal failure increases and there is a corresponding increase in the desire to lengthen seal life by reducing seal wear. Consequently, it is an object of this invention to provide protection to seals in a motion compensator to prolong their life.

Another object of this invention is to provide a pressure balanced motion compensator including means for lubricating its seals during the operation of the compensator so that lubricant may protect the seals and prolong their life.

However, even with the best constructed motion compensator and even with protection provided to the seals, seals will fail. When the seals fail, well fluids can escape from the interior of the compensator to the exterior causing environmental damage, loss of well fluids, and perhaps even loss of well equipment and personnel. Accordingly it is another object of this invention to provide a motion compensator which has means for detecting seal failure.

Another objct of this invention is to provide a motion compensator including means for monitoring its seals so that the condition of the seals during the operation of the motion compensator will be known.

Another object of this invention is to provide a pressure balanced motion compensator including means for monitoring the pressure balancing system which enables determination of the extent of failure of the pressure balancing system so that a determination can be made as to whether to end the operation of the motion compensator or continue its operation.

Another object of this invention is to provide a pressure balanced motion compensator including means for accommodating a seepage of fluids past the pressure balancing seals while maintaining the pressure balancing feature.

Another object of this invention is to provide a pressure balanced motion compensator adapted to be positioned in a well pipe including means for determining when the pressure balancing system fails so that operations may be discontinued before the pipe buckles.

Another object of this invention is to provide a method of operating a motion compensator in a manner to detect seal failure.

Another object of this invention is to provide a method of operating a pressure balanced motion compensator to accommodate a seepage of fluids past the pressure balancing seals while maintaining the pressure balancing feature.

Another object of this invention is to provide a method of operating a pressure balanced motion compensator adapted to be positioned in a well pipe to determine the failure of the pressure balancing system and shut down the system before the pipe buckles.

Another object of this invention is to provide a method of operating a motion compensator to continuously furnish lubricant to the seals of the compensator during its extension and contraction.

Another object of this invention is to provide a method of operating a pressure balanced motion compensator including pressure balancing seals and environmental seals in a manner to continuously furnish lubricant to the pressure balancing seals and environmental seals during extension and contraction of the motion compensator.

Another object of this invention is to provide a method of operating a pressure balanced motion compensator including pressure balancing seals and environmental seals in a manner tending to collapse the motion compensator.

These and other objects, features, and advantages of this invention will become apparent from the drawings, the detailed description and the appended claims.

BRIEF DESCRIPTION OF THE DRAWINGS

In the drawings wherein like numerals indicate like parts and wherein illustrative embodiments of a Motion Compensator are shown.

DESCRIPTION OF THE PREFERRED EMBODIMENTS

Figure 1:
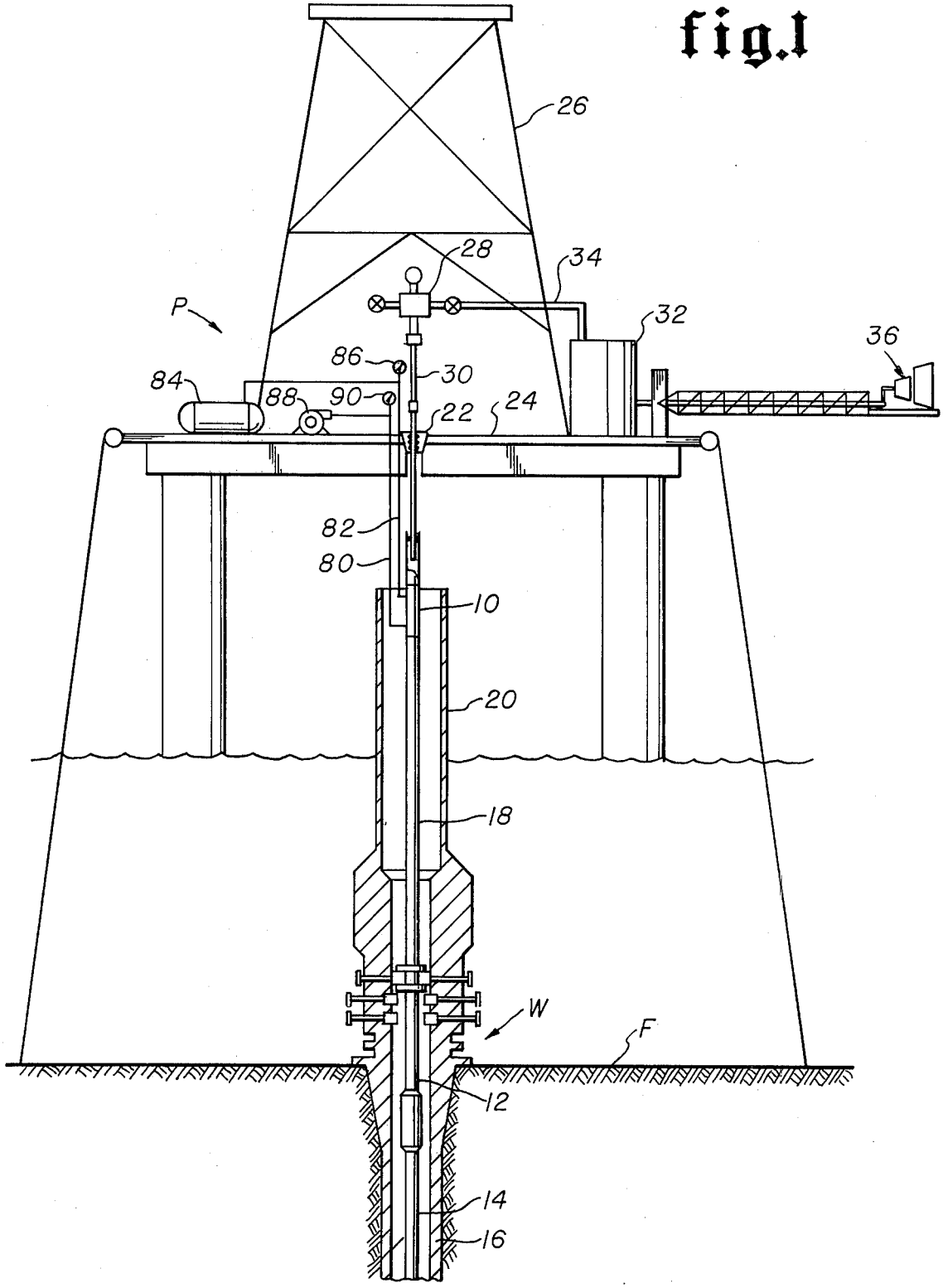
FIG. 1 is a schematic illustration of a drilling system incorporating a motion compensator.

A floating vessel, such as mobile platform P, may be used when a well is drilled below the surface of a body of water. The wellhead W is located at the ocean floor F and is stationary. Due to wave action the platform P oscillates up and down with respect to the wellhead W. The motion compensator 10 of this invention is designed to accommodate the oscillating motion of the platform P with respect to the wellhead W, especially durint testing operations.

Once the well has been drilled, it may be desired to perform a production test or other operation in the well. To perform the operation, a sub surface test tree 12, as disclosed in Taylor U.S. Pat. No. Re. 27,464, the entire disclosure of which is hereby incorporated by reference, may be lowered to the wellhead W and locked in place by a blowout preventor ram. A string 14 extends downwardly from the sub surface test tree 12 through the well casing 16 into the well. Well pipe 18 extends upwardly from sub surface test tree 12 to the platform P within a riser pipe 20. The motion compensator 10 is disposed within the well pipe 18 to accommodate the oscillating movement of the platform P with respect to the wellhead W during performance of the desired test or operation.

The motion compensator 10 may be located in various positions in the well pipe 18 and still accommodate the oscillating movement of the platform P with respect to the stationary wellhead W. As illustrated in FIG. 1, the motion compensator 10 may be hung from the slips 22 of the rotary table and hang below the platform floor 24. The well pipe 18 then depends from the motion compensator 10 and is attached to the sub surface test tree 12 in the wellhead W. Alternatively, the motion compensator 10 may be located directly above the sub surface test tree 12 and the well pipe 18 would extend upwardly to the platform P from the motion compensator 10. Another alternative would be to suspend the motion compensator 10 from the elevators (not shown) near the top of the platform derrick 26 and have the well pipe 18 depend from the motion compensator 10 to the wellhead. Wherever the motion compensator 10 is positioned, one portion will be attached to the stationary wellhead W through well pipe 18 or other means, and another portion will be associated with the movable platform P.

Other equipment that may be associated with the platform P during the performance of the operation may include valved manifold 28 at the upper end of a well pipe section 30 attached to the motion compensator 10, separator facilities 32, conduit means 34 communicating between the manifold 28 and the separator facilities 32, and a burner 36 for burning the fluid produced during the test once it is passed through the separator facilities 32.

Figure 2A:
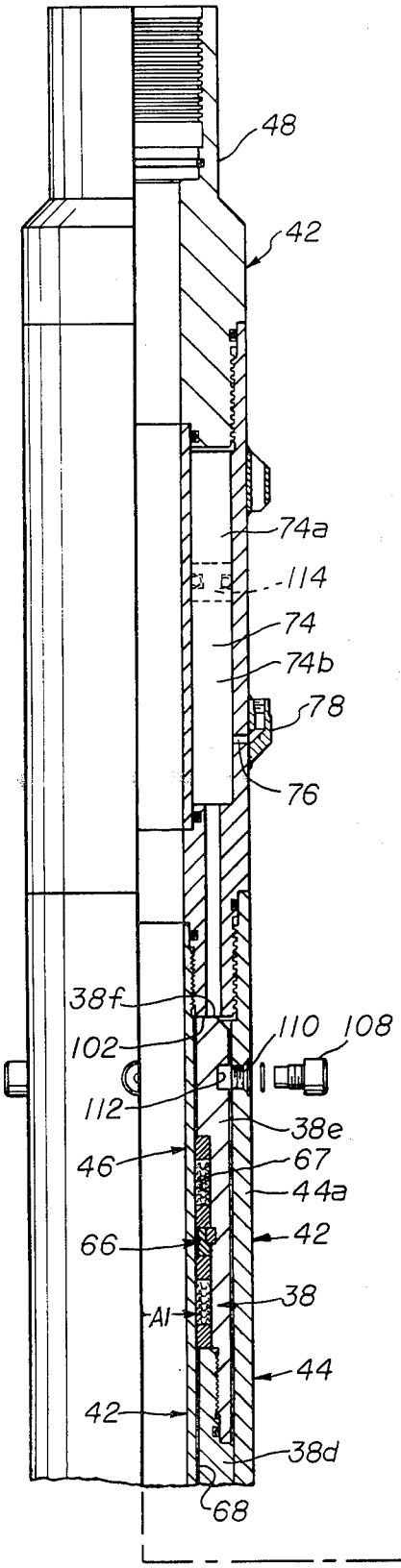
FIGS. 2A, 2B and 2C are continuation views in quarter-section of a motion compensator.
Figure 2B:
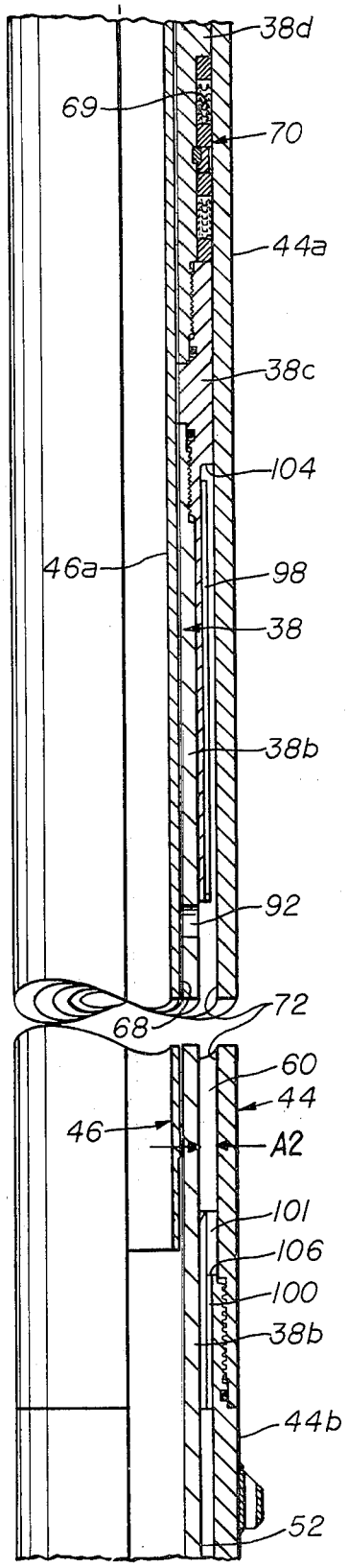
Figure 2C:
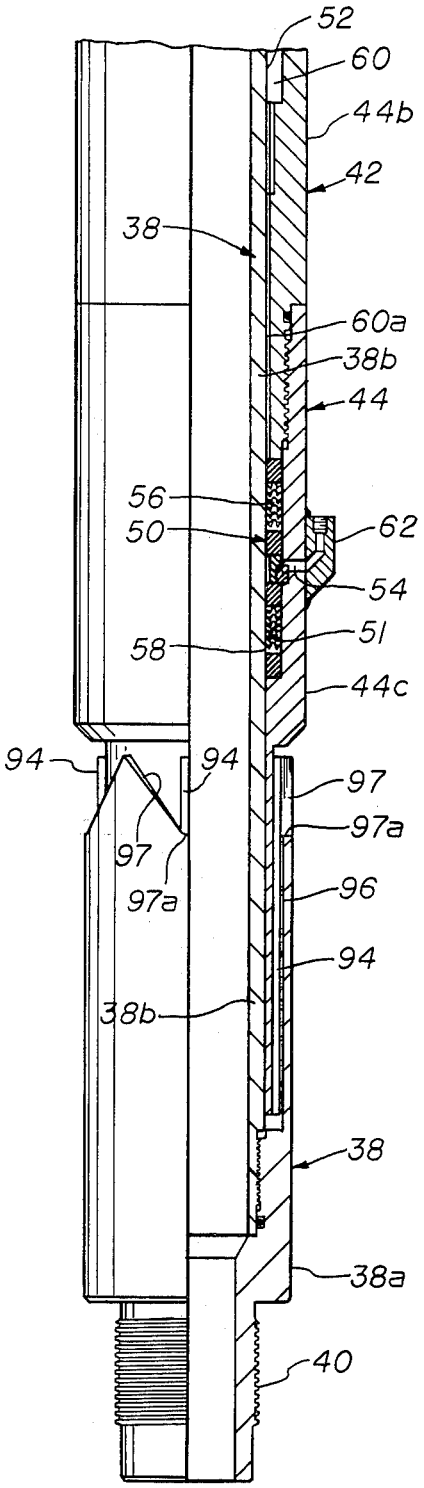

The motion compensator 10 is illustrated in detail in FIG. 2A, 2B and 2C.

The motion compensator includes telescoping means to permit telescoping movement between one end of the compensator adapted to be associated with the stationary wellhead W and the other end of the compensator adapted to be associated with the floating platform P. Two seal systems are provided in the motion compensator. One seal system, the environmental seal system, prevents well fluids within the compensator from leaking to the environment. The other seal system, the pressure balancing seal system, balances the forces due to well fluids within the motion compensator so that only forces in addition to well fluids acting upon the motion compensator, such as platform P movement, will tend to either expand or contract the compensator. To increase the life of the seal systems, the seal means are lubricated and the motion compensator includes port means to permit an injection of lubricant to each seal system.

The means for permitting the telescoping motion are provided by two mandrel means which telescope with respect to each other. The choice of the particular mandrel means to be associated with the stationary wellhead W or with the moving platform P is not important.

In the illustrated motion compensator, a lower tubular mandrel means indicated generally at 38 extends upwardly from sub **38*a* having threads 40 which permit the tubular mandrel means 38 to be attached to well pipe 18. Mandrel means 38 includes lower sub 38*a* and several attached sleeve sections 38*b*, 38*c*, 38*d*, and 38*e* above the sub 38*a*. Tubular mandrel means 38** will thus be stationary.

Telescoping mandrel means indicated generally at 42 is designed to telescope over tubular mandrel means 38 to accommodate the oscillating motion of the platform P. Telescoping mandrel means 42 includes interconnected, concentric, outer tubular housing means 44 and inner sleeve means 46. Housing means 44 includes several interconnected sections **44*a*, 44*b* and 44*c*. Housing means 44 and the sleeve means 46 are adapted to be disposed around the upper sleeve sections 38*e*, 38*d*, 38*c* and 38*b* of tubular mandrel means 38. The telescoping mandrel means 42 includes an upper threaded sub 48 so that it may be connected to well pipe 30** associated with the floating platform P.

To prevent well fluids within the motion compensator from leaking to the environment an environmental seal system indicated generally at 50 (See FIG. 2C) is provided between tubular mandrel means 38 and housing means 44. Preferably this environmental seal system 50 comprises a seal assembly carried within a recess 51 in the lower end of the housing means 44 and is adapted to seal between the outer surface 52 of tubular mandrel means 38 and housing means 44. In this location first port means 54 through housing means 44 permit injection of lubricant to the seal assembly 50. Preferably the environmental seal system 50 comprises two seal means 56 and 58 one of which is disposed on each side of port means 54. One seal means 56, the primary environmental seal will be subjected to well fluids in the annular cavity 60 between housing means 44 and tubular mandrel means 38 and will also be subjected to lubricant injected through port means 54. The primary pressure differential created by the well fluids is borne by this primary environmental seal means 56 and it is designed to be the first seal means of the environmental seal system 50 to fail. Second seal means 58 functions as a backup environmental seal when primary seal means 56 fails.

Connector means 62 is in fluid communication with first port means 54 and is adapted to be connected to conduit means 80 (See FIG. 1) extending to platform P. Lubricant flows through conduit means 80 to lubricate the environmental seal system 50 during the operation of the motion compensator.

The pressure balancing seal system (See FIGS. 2A and 2B) provides a means to balance the force of well fluids within the motion compensator. The pressure balancing seal system includes first seal means, indicated generally at 66, between tubular mandrel means 38 and sleeve means 46 and second seal means, indicated generally at 70, between tubular mandrel means 38 and housing means 44. To provide for as much relative movement between tubular mandrel means 38 and telescoping mandrel means 42 as is possible and to facilitate the lubrication of the pressure balancing seal system, the first seal means 66 is preferably located within an annular recess 67 at the upper end of tubular mandrel means 38 and is adapted to seal between the outer surface 68 of the sleeve means 46 and tubular mandrel means 38, while the second seal means 70 is preferably located within a recess 69 at the upper end of the tubular mandrel means 38 and is adapted to seal between the inner surface 72 of the housing means 44 and tubular mandrel means 38.

To lubricate the pressure balancing seal system a lubricant chamber is provided. The lubricant chamber is defined by the first and second seal means 66 and 70 of the pressure balancing seal system, telescoping mandrel means 42, the upper portion of the tubular mandrel means 38, and a reservoir 74. When the motion compensator is collapsed (as shown in FIG. 2) the lubricant chamber is reduced to its smallest volume. The volume of the lubricant chamber increases as the motion compensator extends. Second port means 76 through the telescoping mandrel means 42 permits injection of lubricant to the reservoir 74.

Connector means 78 is in fluid communication with port means 76. Connector means 78 is adapted to be connected to conduit means 82 (See FIG. 1) extending to the surface through which lubricant flows to lubricate the pressure balancing seal system including the first and second seal means 66 and 70, during the operation of the motion compensator.

The seal life of the seal means of each seal system is prolonged by injecting lubricant to each seal means. Because of the injected lubricant, each seal means remains impregnated with clean lubricant and the sealing surfaces are cleaned of abrasive particles. Less heat and abrasion develops between the seal means and the sealing surfaces, thereby reducing seal wear and extending seal life.

To inject lubricant to the seal systems during the operation of the motion compensator 10 conduit means 80 and 82 (See FIG. 1) extend from the platform P to the compensator 10 and are connected to the connecting means 62 and 78 respectively.

The conduit means 82 conducts lubricant from a source 84 to annular lubricant reservoir 74. Lubricant in reservoir 74 lubricates the pressure balancing seal system. Gauge means 86 may be provided to monitor the pressure in reservoir 74.

Similarly, conduit means 80 provides a means for injecting lubricant from a source 88 to the environmental seal system 50. Gauge means 90 may also be provided to monitor the pressure at the lower seal unit 50.

Preferably the seal systems are sized so that the motion compensator is pressure balanced, whereby the well forces tending to expand the compensator are balanced by forces tending to contract the compensator so that only forces other than well fluid pressure exerted on the compensator contracts or expands the compensator. In the illustrated motion compensator the forces due to well fluids within the motion compensator acting over the circular cross-sectional area A1, defined by the inner diameter of seal means 66, tend to expand the joint. If a communicating means, such as port means 92 through the tubular mandrel means 38 (see FIG. 2B), is provided, the forces due to well fluids within the motion compensator 10 acting on the annular area A2 defined by the outside diameter of seal means 70, and the inside diameter environmental seal system 50 tend to contract the joint. The circular cross sectional area A1, is preferably sized relative to the annular cross sectional area A2 so that these forces are equal. With the effect due to well fluids balanced only forces exerted upon the compensator other than well fluids, such as due to the oscillation of the vessel P, would tend to expand or contract the compensator.

Preferably the motion compensator includes interacting spline means so that torque may be transmitted through the motion compensator to positions below the motion compensator. If desired, spline means could interact throughout the entire telescoping movement of telescoping mandrel means 42 with respect to tubular mandrel means 38. However on the illustrated motion compensator, the spline means interacts when the motion compensator is in a collapsed position or when the motion compensator is in extended position. The spline means which interact when the compensator is in a collapsed position include lower engaging means 94 on the lower end of the telescoping mandrel means 42 engageable with slot means 96 associated with the lower sub **38*a* of tubular mandrel means 38. (See FIG. 2C) The lower sub 38*a* may include guide teeth means 97, with the slot means 96 extending from the root 97*a* thereof, to guide engaging means 94 with slot means 96. The spline means which interact when the tool is extended include upper engaging means 98 on the exterior surface of the tubular mandrel means 38 below sleeve section 38*c* (See FIG. 2B) and slot means 100 on the interior surface of section 44*b* of housing means 44. The section 44*b* may also include guide teeth means 101 to guide upper engaging means 98 into slot means 100**.

Means are provided to limit the telescoping movement of telescoping mandrel means 42 with respect to tubular mandrel means 38. The limiting means stops movement of telescoping mandrel means 42 when it moves to a select, contracted position with respect to tubular mandrel means 38 and stops movement of telescoping mandrel means 42 when it moves to a select, extended position with respect to tubular mandrel means 38. To stop movement at contracted position, the upper end **38*f* of tubular mandrel means 38 contacts stop shoulder means 102 of telescoping mandrel means (See FIG. 2A). To stop movement at the extended position, stop shoulder means 104 of tubular mandrel means 38 (See FIG. 2B) engages stop shoulder means 106 of telescoping mandrel means housing means 44** (See FIG. 2C).

To facilitate handling of the motion compensator 10, means are provided to maintain the motion compensator 10 in a collapsed condition. These means may be a plug 108 which extends through ports 110 of housing means 44 to engage lockout recess 112 of tubular mandrel means 38. Before the motion compensator 10 is positioned within well pipe 18, plug 108 is removed, freeing telescoping mandrel means 42 for movement with respect to tubular mandrel means 38. Suitable plugs (not shown) may then be inserted to block ports 110 of housing means 44.

In operation, the motion compensator 10 is utilized to compensate for the oscillating motion of a floating platform P relative to a stationary subsea wellhead W. The motion compensator 10 is installed in well pipe 18 between the wellhead W and the platform P. Associated with the stationary wellhead W is a stationary tubular mandrel means 38. To accommodate for the oscillating motion of platform P, telescoping mandrel means 42 telescopes over tubular mandrel means 38. Lubricant is injected to both the environmental seal system 50 and the pressure balancing seal system.

During the utilization of the motion compensator 10 the seal life of the seal means in each seal systems can be monitored.

To monitor the seal life of the environmental seal system 50, gauge means 90 monitors the pressure of injected lubricant. The pressure of the injected lubricant should be known and is preferably less than the pressure of well fluids within the motion compensator. The injected lubricant lubricates both the primary and backup seal means 56 and 58. Since the primary seal means 56 is subject to abrasive well fluids while the backup seal means 58 is initially subject only to lubricant and sea water, the primary seal means 56 should fail first. When primary seal means 56 fails, well fluids will seap past it and register an increase of pressure upon gauge means 90. The registered increase of pressure indicates failure of primary seal means 56. The relative amount of increase, indicates the extent of failure.

Even though primary seal means 56 of the environmental seal system 50 has failed, the operation of the motion compensator 10 may be continued because backup seal means 58 should still be effective. Preferably the continued operation of the motion compensator 10 is in a manner which inhibits well fluids from contacting backup seal means 58.

To inhibit well fluids from contacting backup seal means 58 once primary seal means 56 has failed, lubricant is conducted to the environmental seal system 50 at a pressure greater than the pressure of well fluids within the compensator. Well fluids will flow into and from annular cavity 60 and the bore of the compensator through port means 92. However, because the pressure of the lubricant is greater than the pressure of the well fluids, the lubricant will fill the lower portion **60*a* of the annular cavity. The high pressure lubricant fills this lower portion 60*a* because its volume remains relatively unchanged even though, the volume of the entire cavity 60 changes, and because the lubricant is at a pressure higher than that of the well fluids. With the high pressure lubricant filling the lower portion 60*a*, well fluids are inhibited from contacting backup seal means 58 thereby prolonging its seal life while permitting continued operation of the motion compensator 10**.

When both seal means 56 and 58 of the environmental seal system 50 fail, well fluids within the compensator will leak to the environment. This leakage can generally be visually spotted. However, it is desirable, for environmental reasons, to stop operation of the motion compensator 10 before leakage to the environment occurs. Once primary seal means 56 has failed it is possible to estimate the life of backup seal means 50 so that the operation of the motion compensator 10 can be stopped before leakage to the environment occurs. The life span of the backup seal means 58 once the primary seal means 56 has failed should be approximately the same as life span of the primary seal means 56.

To monitor the seal life of the pressure balancing seal system 64, gauge means 86 monitors the pressure of lubricant injected into the lubricant chamber. The pressure of the injected lubricant is known and is preferably less than the pressure of well fluids within the motion compensator but greater than atmospheric pressure. When one or both of the first and second seal means 66 and 70 fails, well fluids will seep past the failed seal means and register an increase of pressure upon the gauge means 86 thereby indicating a seal failure. The extent of seal failure (e.g. whether there is a mere seepage of well fluids past the failed seal means or whether there is a steady flow of well fluids past the failed seal means) can be determined by the magnitude of the increase in pressure.

When one or both of the first and second seal means 66 and 70 has failed, well fluids entering into the lubricant chamber may prevent complete collapse of the motion compensator 10 and the seepage of fluids past the seal means may cause loss of the pressure balancing feature. The well fluids seeping past the failed seal means should either be accommodated, or the operation of the motion compensator 10 should be stopped.

The accommodation of the seeping well fluids removes the fluids from the lubricant chamber to both permit complete collapse of the motion compensator 10 and to maintain the pressure balancing feature. The seeping well fluids can be accommodated by permitting unrestricted flow of these fluids out of the lubricant chamber to a storage point. For example, source means 84 may be a low pressure accumulator means 84 and the diameter of conduit means 82 and port means 76 could be large enough to permit a free flow of lubricant and seeped well fluids into and out of the lubricant chamber.

When an increase of pressure is registered on gauge means 86, indicating a seal failure of one or both of the seal means of the pressure balancing seal system, the operator can determine whether to continue the test and utilization of the motion compensator or whether to shut down. If the increase of pressure is small, indicating a mere seepage past the failed seal means, he may determine to accommodate the seeping fluids, particularly if the test is near completion. By accommodating the seeped fluid by bleeding it out of the lubricant chamber as fast as it enters the lubricant chamber, the motion compensator 10 will maintain its ability to completely collapse and the pressure balancing feature will be maintained. The accommodated, seeped fluid is not lost to the environment, but is stored in accumulator means 84. The amount of seeped fluids indicate the extent of seal failure. Once the seeped fluids can no longer be accommodated, the operation should be shut down to prevent buckling of the well pipe 18.

The injection of lubricant into the annular reservoir 74 should be accomplished to permit a complete collapsing of the motion compensator 10. Too much fluid in the lubricant chamber, prevents complete collapse of the motion compensator 10 by creating a shock absorber or bumper affect.

There are several methods of preventing lubricating fluid within the lubricant chamber from creating a shock absorber effect.

First, the manner in which lubricant is conducted to the annular reservoir 74 can be controlled. For example, lubricant can be pumped to the reservoir 74 while gauge means 86 is monitored. When the gauge reading exceeds a certain amount the pumping can be stopped. Alternatively, the motion compensator can be collapsed to reduce the annular reservoir 74 to its smallest of volume. Then the reservoir 74 can be filled with lubricant.

Second, the lubricant under a few pounds of pressure can be maintained in the annular reservoir 74 and accommodated when the motion compensator is collapsed. To maintain and accommodate lubricant within the annular reservoir 74, source means 84 may be a low pressure accumulator means 84 and the diameter of conduit means 82 and of port means 76 could be large enough to permit unrestricted flow of lubricant into or out of annular reservoir 74. When the motion compensator 10 expands, lubricant from accumulator means 84 flows into the annular reservoir 74. When the motion compensator contracts, excess lubricant in the reservoir 74 is accommodated, and the shock absorber affect avoided, by being expelled from the reservoir 74 and flowing back to accumulator means 84. Alternatively, an annular free piston means 114 (shown in dotted form in FIG. 2A) could be disposed within the annular reservoir 74 to provide low pressure accumulator means within the lubricant chamber. Lubricant would be injected into the lubricant chamber between piston means 114 and the pressure balancing seal system. The reservoir **74*a* above piston means 114 would be filled with low pressure gas. The lubricant within the lubricant chamber would exert the same pressure across the pressure balancing seal system as is exerted by the gas. When the motion compensator extends, piston means 114 moves to a position increasing the volume of reservoir 74 while maintaining the volume of lubricant constant. When the motion compensator contracts, the lubricant is accommodated by piston means 114 moving to a position reducing the volume of the reservoir 74*a* above the piston means 108 and permitting the lubricant to flow into the reservoir 74*b* below the piston means 114**.

The pressure balancing seal system can be monitored to determine whether the lubricant in reservoir 74 has been used up so that more must be added. When lubricant is pumped into chamber 74 guage means 86 is monitored. If the pressure within the reservoir 74, as indicated by gauge means 86, increases quickly, lubricant remains within the reservoir 74 and further injection of lubricant into the reservoir 74 is unnecessary. If however, the pressure within the reservoir 74 does not increase quickly, little lubricant remains 74 and lubricant should be injected into the reservoirs 74 to lubricate the pressure balancing seal system 64.

To transmit torque through the motion compensator 10, the compensator is extended or collapsed until the respective spline means engage and interact. The compensator is maintained in this position, and torque transmitted therethrough, by rotating the Kelley (not shown) and the well pipe 18 connected to the motion compensator.

Figure 3:
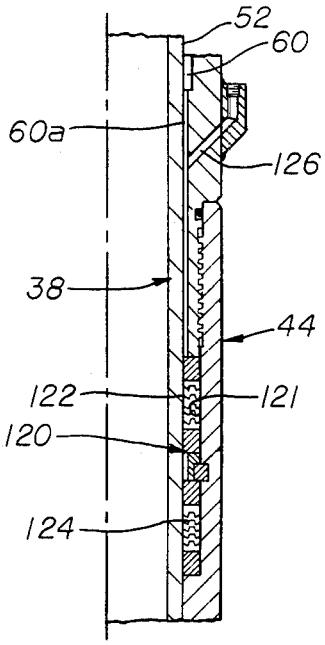
FIG. 3 is a fragmentary sectional view of an alternative embodiment of the lower portion of the motion compensator of FIGS. 2A, 2B and 2C.

As illustrated in FIG. 3, an alternative arrangement may be provided for the environmental seal system and its lubricating port means. Since the rest of the motion compensator is unchanged FIG. 3 illustrates only the lower portion of the motion compensator and like numerals have been used for like parts.

The environmental seal system indicated generally at 120 prevents leakage to the environment and is disposed between tubular mandrel means 38 and housing means 44. It is preferably located within an annular recess 121 of housing means 44 and adapted to seal with the exterior surface 52 of tubular mandrel means 38. The seal system 120 preferably includes upper primary seal means 122 and lower backup seal means 124.

Port means 126 through housing means 44 permits injection of lubricant to the environment seal system 120. Port means 126 opens into annular cavity **60*a* above but adjacent to the seal system 120. Lubricant may be maintained in this lower portion 60*a* of annular cavity 60 to lubricate the environmental seal system 120**.

The operation of the motion compensator, with the alternative environmental seal system 120 and port means 126 is similar to the operation of the first embodiment of the motion compensator after the primary seal means 56 of the environmental seal system 50 has failed. Lubricant is maintained in the lower portion **60*a* of the annular cavity 60 to lubricate the environmental seal system 120, by injecting lubricant through port means 126 at a pressure in excess of the pressure of the well fluids within the motion compensator. In this manner, although the well fluids will seep into the annular cavity 60 through port means 92 they will be inhibited from contacting the environmental seal system 120**.

The failure of both seal means 122 and 124 can be detected by observing a leakage of fluid past the seal system 120 to the environment.

Because the pressure of lubricant injection through port means 126 is greater than the pressure of well fluids within the bore of the motion compensator, the motion compensator has a tendency to collapse (e.g., the force tending to collapse the motion compensator equals the pressure of injected lubricant times A2, the annular cross-sectional area defined by the outside diameter of seal means 70 and the inside diameter of environmental seal system 120, while the force tending to expand the motion compensator equals the pressure of well fluids within the bore times A1, the circular cross-sectional area defined by the inner diameter of seal means 66. Since A1 is designed to be equal to A2, and since pressure of injected lubricant is greater than the pressure of well fluids, the force tending to collapse the compensator is greater than the force tending to expand the compensator). Operating the motion compensator so that it has a tendency to collapse may be preferable because there would then be less likelihood that the well pipe 18 would buckle.

It would be apparent that in the embodiment illustrated in FIG. 3, more lubricant is required to lubricate the environmental seal system than is required for the embodiment illustrated in FIGS. 2A, 2B and 2C. The FIG. 3 embodiment required more lubricant because, even before the primary seal 122 fails, a portion of the lubricant is lost through port 92 while in the FIG. 2A, 2B and 2C embodiment no lubricant is lost until the primary seal 56 fails.

From the foregoing it can be seen that the objects of this invention have been obtained. A motion compensator has been provided wherein means are provide which permit the seals between the telescoping parts of the compensator to be lubricated resulting in less heat and abrasion on the seal surfaces and increasing the operating life of the motion compensator. By observing the gauges which monitor the pressure of lubricant, it can be determined when the seals fail so that corrective steps, can be conducted before much damage has occurred. Additionally a method of utilizing a motion compensator has been provided which permits determining when the seals have failed, determining the extent of failure, and continued operation of the compensator even after some of the seals have partially failed.

The foregoing disclosure and description of the invention are illustrative explanatory thereof and various changes in the size, shape and materials, processes, as well as in the details of the illustrated construction may be made within the scope of the appended claims without departing from the spirit of the invention.

What is claimed is:

1. A motion compensator comprising:

telescoping mandrel means including interconnected concentric outer tubular housing means and inner sleeve means;

tubular mandrel means disposed between said housing means and said sleeve means;

a pressure balancing seal system including:

first seal means between said tubular mandrel means and said sleeve means, and second seal means between said tubular mandrel means and said housing means;

said first and second seal means in conjunction with said telescoping mandrel means and said tubular mandrel means defining a chamber;

an environmental seal system spaced from said pressure balancing seal system including seal means between said tubular mandrel means and said housing means;

said second seal means and said environmental seal system in conjunction with said housing means and said tubular mandrel means defining an annular cavity;

first port means through said housing means permitting lubricant to be injected to said environmental seal system;

second port means through said housing means to said chamber permitting lubricant to be injected to said pressure balancing seal system; and communicating means between said annular cavity and the bore of said sleeve means.

2. The motion compensator of claim 1 wherein:

said first port means opens into said annular cavity near said environmental seal system; and said communicating means includes port means through said tubular mandrel means spaced from said first port means.

3. The motion compensator of claim 2 including:

conduit means extending from the surface to said motion compensator and connected in communication with said first port means; and pump means injecting lubricant into said conduit means at a pressure greater than the pressure of well fluids within the compensator.

4. The motion compensator of claim 1 including:

gauge means for monitoring the pressure of fluid in said chamber.

5. The motion compensator of claim 1 including:

gauge means for monitoring the pressure at said first port means.

6. The motion compensator of claim 1 wherein:

the circular cross-sectional area defined by the inside diameter of the first seal means and the annular cross-sectional area between the outside diameter of said second seal means and the inside diameter of said environmental seal system are such the forces due to well fluids which will act upon the circular cross-sectional area are less than those due to injected lubricant which will act upon the annular cross-sectional area.

7. The motion compensator of claim 1 including:

conduit means extending from the surface to the motion compensator and connected in communication with each of said port means.

8. The motion compensator of claim 1 including:

conduit means extending from the surface to the motion compensator and connected in communication with said second port means; and source means injecting lubricant under low pressure into said conduit means.

9. The motion compensator of claim 1 including:

conduit means extending from the surface to said motion compensator and connected in communication with said first port means; and pump means injecting lubricant into said conduit means.

10. The motion compensator of claim 1 including:

conduit means extending from the surface to the motion compensator and connected in communication with said second port means;

source means injecting lubricant under low pressure into said conduit means;

conduit means extending from the surface to said motion compensator and connected in communication with said first port means; and pump means injecting lubricant into said latter conduit means.

11. A motion compensator comprising:

telescoping mandrel means including interconnected outer tubular housing means and inner sleeve means;

tubular mandrel means disposed between said housing means and said sleeve means;

a pressure balancing seal system including:

first seal means between said telescoping mandrel means and said sleeve means, and second seal means between said telescoping mandrel means and said housing means;

said first and second seal means in conjunction with said telescoping mandrel means and said tubular mandrel means defining an annular chamber;

low pressure accumulator means adapted to contain lubricant;

means conducting lubricant between said low pressure accumulator means and said chamber;

an environmental seal system spaced from said pressure balancing seal system including seal means between said telescoping mandrel means and said housing means;

said second seal means and said environmental seal system in conjunction with said housing means and tubular mandrel means defining an annular cavity;

first port means through said housing means permitting injection of lubricant to said environmental seal system; and communicating means between said annular cavity and the bore of said sleeve means.

12. The motion compensator of claim 11 wherein:
said first port means opens into said annular cavity near said environmental seal system; and
said communicating means includes port means spaced from said first port means.

13. The motion compensator of claim 11 including:
gauge means monitoring the pressure of lubricant injected into said chamber.

14. The motion compensator of claim 11 including:
gauge means monitoring the pressure of lubricant injected through said first port means.

15. The motion compensator of claim 11 wherein:
the circular cross-sectional area defined by the inside diameter of said first seal means and the annular cross-sectional area between the outside diameter of said second seal means and the inside diameter of said environmental seal system are such the forces due to well fluids which will act upon the circular cross-sectional area are less than those due to injected lubricant which will act upon the annular cross-sectional area.

16. A motion compensator comprising:
telescoping mandrel means including interconnected outer tubular housing means and inner sleeve means;
tubular mandrel means disposed between said housing means and said sleeve means;
a pressure balancing seal system including:
first seal means between said tubular mandrel means and said sleeve means, and
second seal means between said tubular mandrel means and said housing means;
said first and second seal means in conjunction with said telescoping mandrel means and said tubular mandrel means defining a chamber including a reservoir;
low pressure accumulator means disposed in said reservoir;
an environmental system spaced from said pressure balancing seal system including seal means between said tubular mandrel means and said housing means;
said second seal means and said environmental seal system in conjunction with said housing means and tubular mandrel means defining an annular cavity;
first port means to permit conduction of lubricant to said environmental seal system;
second port means to permit conduction of lubricant to said annular chamber between said accumulator means and said first seal system; and
communicating means between said annular cavity and the bore of said sleeve means.

17. The motion compensator of claim 16 wherein:
said first port means opens into said annular cavity near said environmental seal means; and
said communicating means includes port means spaced from said first port means.

18. The motion compensator of claim 16 including:
gauge means monitoring the pressure injected through said first port means.

19. The motion compensator of claim 16 wherein:
the circular cross-sectional area defined by the inside diameter of said first seal means and the annular cross-sectional area defined between the outside diameter of said second seal means and the inside diameter of said environmental seal system are such the forces due to well fluids which will act upon the circular cross-sectional area are less than those due to injected lubricant which will act upon the annular cross-sectional area.

20. The motion compensator of claim 16 including:
conduit means extending from the surface to the motion compensation and connected in communication with each of said port means.

21. A motion compensator comprising:
telescoping mandrel means including outer tubular housing means;
tubular mandrel means disposed within said housing means;
an environmental seal system including seal means between said tubular mandrel means and said housing means;
port means through said housing means permitting lubricant to be injected to said environmental seal system and opening near said seal means;
conduit means extending from the surface to said motion compensator and connected in communication with said port means;
means for transmitting lubricant through said conduit means so that lubricant may flow through said port means and be injected to said environmental seal system during the operation of said motion compensator; and
guage means adapted to monitor the pressure of injected lubricant.

22. A motion compensator comprising:
telescoping mandrel means including interconnected outer tubular housing means and inner sleeve means;
tubular mandrel means disposed between said housing means and said sleeve means;
a seal system including:
first seal means between said tubular mandrel means and said sleeve means; and
second seal means between said tubular mandrel means and said housing means;
port means through said housing means permitting injection of lubricant to a chamber defined by said first and second seal means, said telescoping mandrel means and tubular mandrel means;
conduit means extending from the surface to said motion compensator and connected in communication with said port means,
means for transmitting lubricant through said conduit means so that lubricant may flow through said port means and be injected to said seal system during the operation of said motion compensator; and
guage means adapted to monitor the pressure of injected lubricant.

23. The method of operating a motion compensator said motion compensator including telescoping mandrel means having interconnected outer tubular housing means and inner sleeve means; tubular mandrel means disposed between said housing means and said sleeve means; first seal means between said tubular mandrel means and said sleeve means; second seal means between said tubular mandrel means and said housing means; and port means through said housing means permitting injection of lubricant to an annular chamber defined by said first and second seal means, said telescoping mandrel means and said tubular mandrel means; the method comprising the steps of:
operating said motion compensator with both of said seal means subject to well fluids;
injecting lubricant at a low pressure to said annular chamber;

monitoring the pressure of injected lubricant; and registering a change of pressure when at least one of said seal means fails.

24. The method of claim 23 including the step of:

accommodating well fluids which seep past said failed seal means.

25. The method of claim 23 including the step of: stopping the operation of said motion compensator.

26. The method of operating a motion compensator, said motion compensator including tubular mandrel means, tubular housing means telescoped around said tubular mandrel means, a seal system including seal means between said tubular housing means and said tubular mandrel means, and port means through said housing means opening near said seal means; the method comprising the steps of:

positioning the motion compensator within a well pipe string extending between a stationary underwater wellhead and a floating platform so that the motion compensator can accommodate oscillating movement of the floating platform with respect to the stationary underwater wellhead; and injecting lubricant through said port means during the operation of said motion compensator.

27. The method of operating a motion compensator, said motion compensator including tubular mandrel means, tubular housing means telescoped around said tubular mandrel means, a seal system including seal means between said tubular housing means and said tubular mandrel means, and port means through said housing means opening near said seal means; the method comprising the step of:

injecting lubricant through said port means during the operation of said motion compensator with the pressure of injected lubricant being greater than the pressure of well fluid within the bore of the motion compensator.

* * * * *